United States Patent [19]

Price

[11] 4,008,670

[45] Feb. 22, 1977

[54] FOLDABLE SAMPLE DISPLAY TABLE

[76] Inventor: Raymond C. Price, 756 S. Jason St., Denver, Colo. 80225

[22] Filed: May 21, 1975

[21] Appl. No.: 579,464

[52] U.S. Cl. ..... 108/28; 108/159; 211/200; 248/164

[51] Int. Cl.[2] ..... A47B 41/04

[58] Field of Search ..... 108/159, 156, 28, 158; 211/178 R, 178 A, 169, 200; 248/167, 166, 164

[56] References Cited

UNITED STATES PATENTS

| | | | |
|---|---|---|---|
| 432,425 | 7/1890 | Moan | 108/159 |
| 1,885,635 | 11/1932 | Schweitzer | 108/158 |
| 2,706,609 | 4/1955 | Sullivan | 248/167 |
| 3,258,236 | 6/1966 | Moritz | 248/166 |
| 3,338,189 | 8/1967 | Xavier | 108/159 |
| 3,387,808 | 6/1968 | Metcalf | 248/166 |
| 3,528,560 | 9/1970 | Price | 211/178 R |

*Primary Examiner*—Roy D. Frazier
*Assistant Examiner*—Darrell Marquette

[57] ABSTRACT

A foldable sample display table having a square top and two substantially flat, similar, upright crossed frame sections whereon the top is placed. The top is removable and the frame sections are pivoted about the upright central axis of the frame table where they cross each other at right angles. For storage or shipment, these sections are folded against each other to a flat structure. Each frame section is formed of rods in an opposing, symmetrical arrangement as opposing wing portions below the table top, a common neck portion below the wings and opposing pedestal below the neck portions. Each rod includes a top portion of the wing which fits into a groove at the underside of the table top and these top portions of the rods hold the table top in place. Each wing includes a vertical arm depending from the underside of the table top near the edge to carry an array of display samples, such as rug samples, mounted on the arms as by hooks. Where comparatively small rods are used for the frame, the rod members of one frame section will carry an upright, tubular post at the central axis and the rod members at the top and bottom of the other frame section can be fitted into the ends of this post to pivot thereabout.

5 Claims, 15 Drawing Figures

F
25
6
25'
M
28
28'
21
27'
S
4
29
27
25
4
28
28'
21'
21'
26
32'
31
32
W
7
7
31
29
21
32
32'
37
33'
33
N
34
34'
25
36
5
34
8
8
35
35'
P
36'
34'
5
35
34
35'

T
20
9
F
21
D
9
D
P 41
20
47
42
28
30
10
31
11
46
11
21
29
D 20
42
41
40
42
41

28'
28'
26
28
28
28
28'
C

32'
32'
32
33
36
26
32
37
32'
32'
C

35'
26
36
35
36'
35'
C

FOLDABLE SAMPLE DISPLAY TABLE

This invention relates to sample display tables and to fixtures of the type wherein samples, such as small pads of various carpet designs, called display samples, can be displayed for easy selection by customers. The invention concerns, more specifically, a sample display table which can be dismantled and folded into a flat, compact package when not in use. As such, the invention is an improvement over the sample display fixture set forth in my U.S. Pat. No. 3,528,560 issued Sept. 15, 1970, for a sample display fixture.

The present invention was conceived and developed to provide additional advantages of the sample display fixture disclosed in U.S. Pat. No. 3,528,560. The primary use for such fixtures is to display binders of samples of various carpet patterns. The fixture is formed of crossed peripheral frames including four upright arms, each of which can carry several samples in a vertical array. That unit has a somewhat bulky appearance, especially when it is only partially loaded with display samples. The present invention comprises, in esssence, a small, neat appearing square table having a foldable frame supporting a removable top. This frame is formed as a pair of crossing peripheral, wire-like members pivoted together at the central vertical axis of the table. When the frame is open, it forms four similar segments, 90° apart. Each segment includes a wing portion under the table top with a portion of the wire-like members forming a vertical arm depending from adjacent the edge of the table top to support carpet display samples, a necked-in portion under this wing portion and a foot, or pedestal, at the base of the unit. These segments are formed of light-weight but rigid rods or wire bent to shape the wing, neck and pedestal, all as hereinafter set forth in detail.

The primary object of the present invention is to provide a novel and improved sample display table which is a neat appearing, simple, economical unit and is versatile in that it may be used for many purposes other than to display samples.

Another object of the invention is to provide a novel and improved sample display table which is formed as a simple, lightweight framework of bent rods in an arrangement which is structurally efficient in that the unit is quite strong for the weight involved.

Another object of the invention is to provide a novel and improved sample display table which can be quickly and easily dismantled and folded into a compact package for storage and shipment and which can be as quickly and easily opened and set up for use.

Another object of the invention is to provide a novel and improved sample display table which is formed in an arrangement which permits it to be quickly and easily adapted for many other purposes.

With the foregoing and other objects in view, my present invention comprises certain constructions, combinations and arrangements of parts and elements as hereinafter described, defined in the appended claims and illustrated in preferred embodiment by the accompanying drawing in which:

Figure 1:
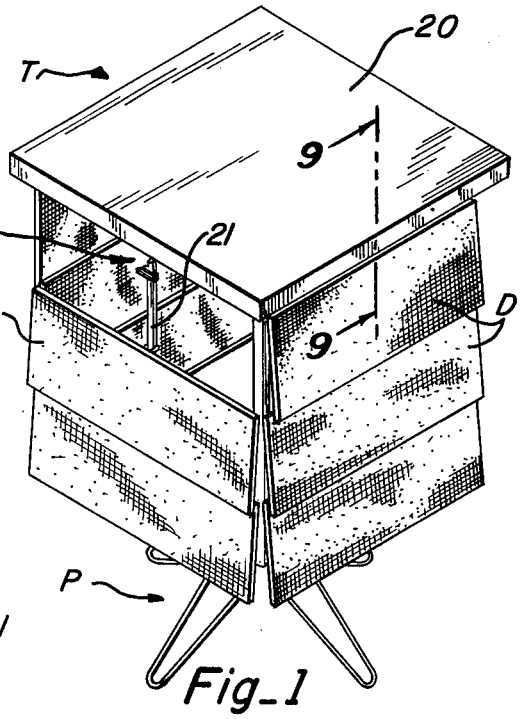
FIG. 1 is an isometric view of a preferred embodiment of the display table having arrays of samples at each side of the table, this figure being illustrative of the general appearance of the table and the manner in which it is used.

Referring more particularly to the drawing, the sample display table T and the manner in which it displays sample binders B is illustrated at FIG. 1. A square top 20 is supported upon a framework F. The framework has depending holding arms 21 below each side of the square top. Display samples D are carried by these holding arms 21 in vertical, lapping arrays as illustrated. This arrangement is suggestive of an upright square prism, and the table is symmetrical about its central, vertical axis, hereinafter called the "table axis".

Figure 2:
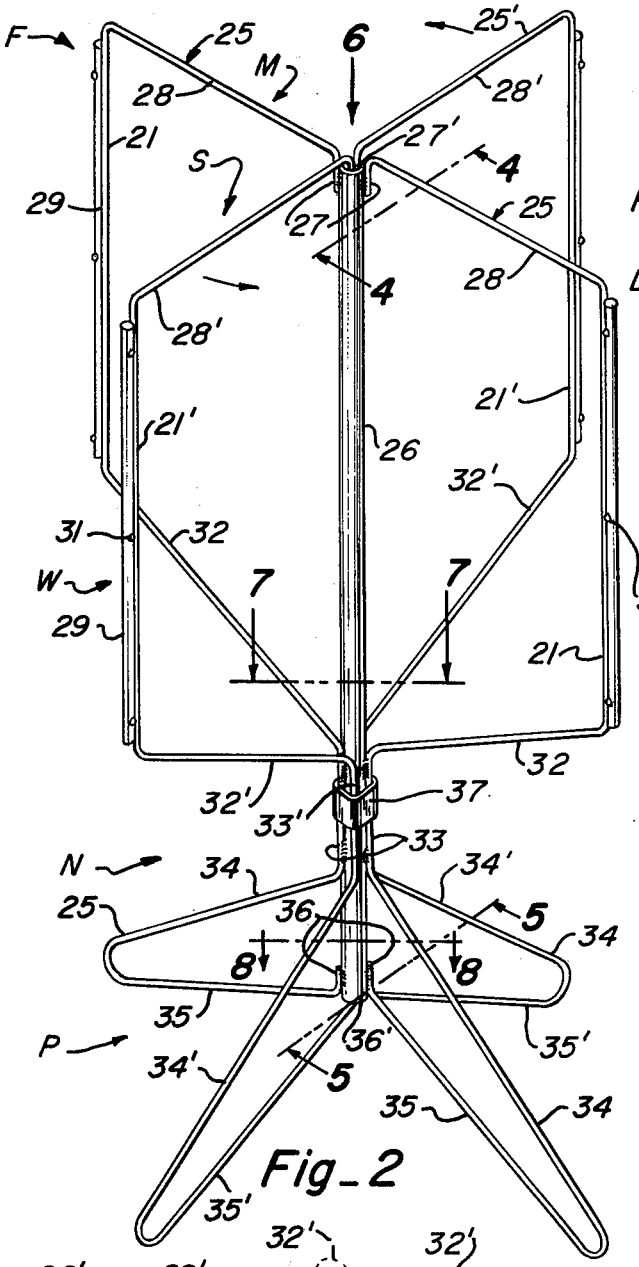
FIG. 2 is an isometric view, on an enlarged scale, of the frame of the table shown at FIG. 1, with the top being removed.
Figure 3:
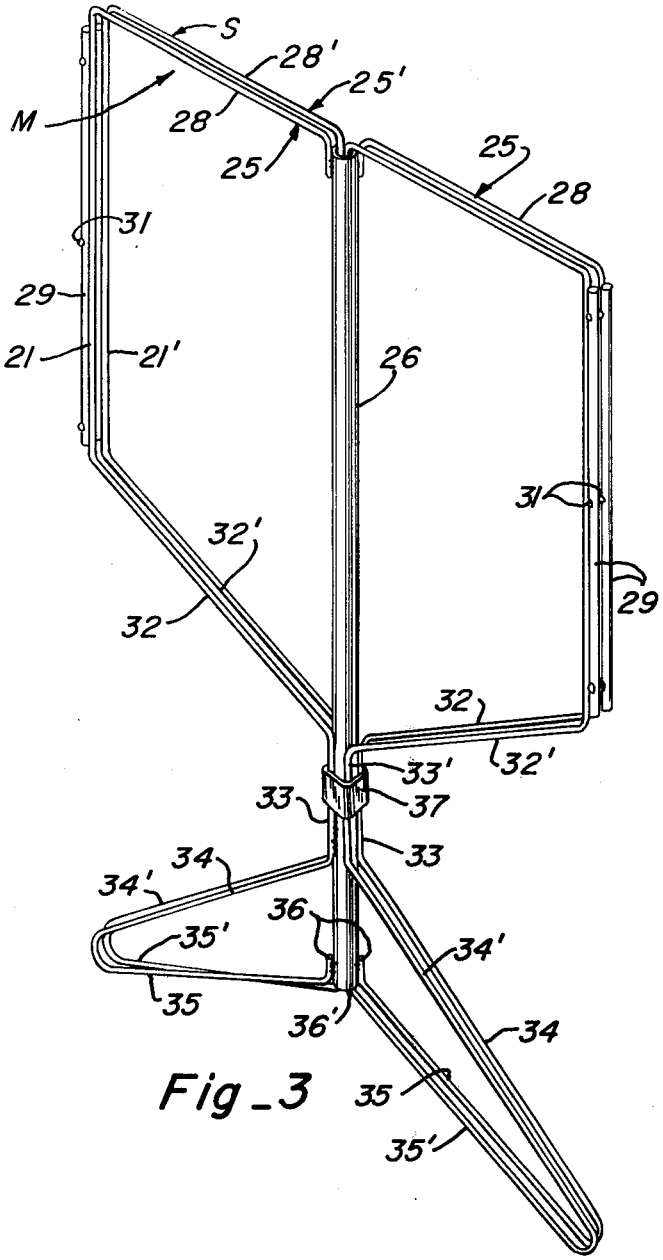
FIG. 3 is an isometric view similar to FIG. 2, but showing the frame members folded together, as for storage or shipment, by rotating one section against the other.

The frame F is made of metal rods heavy enough as to be rigid, but which nevertheless, form a simple, lightweight structure. This frame structure consists of four similar, flat, planar segments which outstand radially from the aforesaid table axis and which are 90° apart as best illustrated at FIG. 2. Each segment includes a wing portion W directly beneath the table top 20, a neck portion N below this wing and a pedestal P below the neck, as heretofore mentioned. Structurally, each segment joins the 180° opposite segment as an essentially flat, planar frame section symmetrical from each side of the table axis. The two planar sections cross each other and are pivotally interconnected at the table axis to form the four segments as mentioned. When the table is in use, these two frame sections are 90° apart but they are adpated to fold together by rotation about the table axis to collapse the frame F to a flat unit as illustrated at FIG. 3.

The frame sections are conveniently designated as a primary section M and a secondary section S, with the primary section M having bearing members to pivotally carry the secondary section S as will be described; otherwise, the sections are essentially identical. As heretofore mentioned, each section, M or S, is formed as a flat, essentially-planar, symmetrical structure which includes two opposing segments.

Each of the two opposing segments of the primary section M is a bent rod 25 and in the embodiment illustrated at FIG. 1–11, the primary section M includes an axially-centered tube 26 whereto the rods 25 are welded. Commencing at the top of this primary section, a downturned end 27 of each rod 25 is welded to the top portion of the tube 26. Thence, each rod 25 extends outwardly, as a radial arm 28 from the tube 26, with the bend between the downturned end 27 and the radial arm 28 being above the top edge of the tube 26, to place the arm 28 thereabove to fit into a table top slot as hereinafter described.

Figure 9:
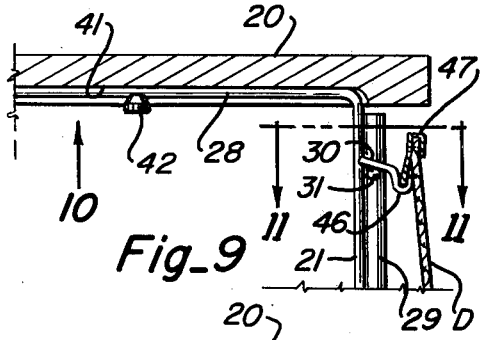
FIG. 9 is a fragmentary sectional detail taken from the indicated line 9—9 at FIG. 1, but on an enlarged scale.
Figure 10:
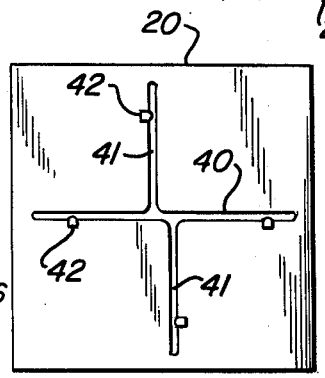
FIG. 10 is an underside view of the table top shown at FIGS. 1 and 9, as from the indicated arrow 10 at FIG. 9, but on a reduced scale.

Each radial arm 28 extends outwardly to a point near the edge of the table top 20, when the top is in place, to turn downwardly and form the vertical holding arm 21 whereon display samples D are mounted. Each holding arm 21 carries an enlarged rod 29 which is welded, or otherwise attached, to it. Support clips 30 are carried on this rod 29 as shown at FIG. 9 and small bosses 31 may be formed on the sides of the rod 29 to hold these clips in place, all as hereinafter further described. Each rod 25 below the bottom of the frame arm 21, turns inwardly and downwardly as a support strut 32 to the side of the tube 26. This portion of the rod 25, the radial arm 28, the frame arm 21 and the support strut 32, forms a wing W of the segment.

Thence, a short neck portion 33 of the rod lies alongside the tube 26 welded to the tube or held by collar 37 forming the neck N of the segment. The rod 25 extends outwardly and downwardly as a compression strut 34 to turn thereunder and return inwardly and upwardly to the tube 26 as a base strut 35. The compression strut and base strut form the pedestal P. The end of this base strut 35 is turned upwardly as a stub 36 which is held in the tube 26 or welded thereto. When welded, two opposite segments are stationary adjacent the other two.

Figure 8:
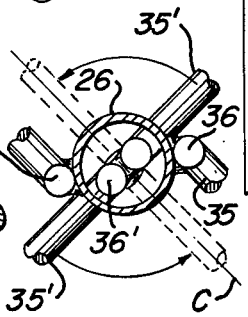
FIG. 8 is a fragmentary sectional detail as taken from the indicated line 8—8 at FIG. 2, but on an enlarged scale and showing frame components in dotted lines in their folded position.

In some cases, the two segments of primary section M do not lie precisely in the same plane in the welded construction, and each may be offset a small distance from the other to lie in closely-spaced parallel planes. In some cases they may be in the same plane as C. With this arrangement, the secondary section S may be flat, extend through the table axis and may rotate about the table axis, as from a plane perpendicular to the primary section M and into the central plane C passing through the table axis which lies between and parallels the spaced planes of the two segments forming the primary section M, all as hereinafter further described. This offsetting of the rods 25 of the primary section M and movement of the secondary section S to the central plane C is best shown at FIGS. 6 and 8.

The secondary section S is similar in form to the primary section, but the bent rods 25′, forming the opposing segments, lie in a common plane as mentioned. Commencing at the top, each rod 25′ includes a downturned end 27′ which is welded to its mate and extends into the upper end of the tube 26, the tube providing a bearing held by the rods 25 of the primary section M. Thence, each rod extends outwardly radially from the tube as a radial arm 28′ which lies above the top of the tube and in the same transverse plane as does the arm 28. The outward end of the arm 28′ turns downwardly to form a holding arm 21′ which carries an enlarged rod 29 having bosses 31 for binder clips 30. Thence, the arm 25′ turns inwardly and downwardly as a support strut 32′. Thence, the rod forms a short neck portion 33′ which lies alongside the tube 26 adjacent to the neck portions 33 of the rods 25. This neck portion 33′ of the rod is held against the tube by a collar 37 embracing the tube 26 and the neck portion 33′ may rotate in this collar 37 when the frame sections are opened or folded together.

The rod 25′ extends from the neck N downwardly and outwardly as a compression strut 34′, to turn and extend inwardly and upwardly as a base strut 35′ to form a pedestal P. Each rod is completed by an upturned stub 36′ which is welded to its mate and fitted into the bottom of the tube 26.

Figure 6:
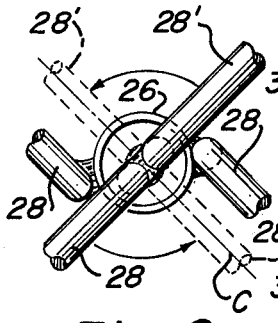
FIG. 6 is a fragmentary plan view of the central portion of the frame as taken from the indicated arrow 6 at FIG. 2, but on an enlarged scale and showing frame components in dotted lines in their folded position.
Figure 7:
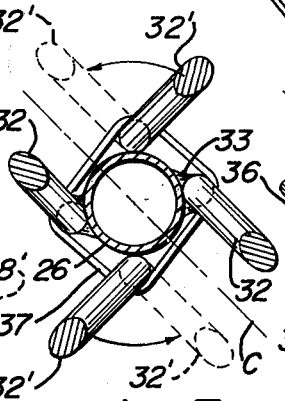
FIG. 7 is a fragmentary sectional detail as taken from the indicated line 7—7 at FIG. 2, but on an enlarged scale and showing frame components in dotted lines in their folded position.

The top portion of the frame, above the tube 26, is illustrated at FIG. 6 where it is seen that the arms 28′ of the secondary frame pivot in the tube 26 from an open position at right angles to the arms 28 of the primary frame, to a folded position paralleling the arms 28 and in the plane C, as shown in dotted lines. The juncture at the neck portions 33 and 33′, illustrated at FIG. 7, shows that the neck portions 33′ are offset from the table axis a short distance, but this misalignment of the neck portion 33, with respect to the opposite ends of the secondary section, is not significant. The normal flexure of the rods 25′ will permit the secondary section S to rotate from an open to a folded position with respect to the primary section without binding, at this neck portion N. The bottom of the frame is illustrated at FIG. 8 where the upturned struts 36′ extend upwardly into the tube 26. The pedestal portions are at right angles to each other in the open position and the secondary section S of the frame can swing from the open right angle position to the folded position paralleling the two members of the primary frame and in the plane C, as shown in dotted lines.

The table top 20 is fitted onto this frame F by slots 40 and 41 at its underside. A single slot 40 extends across the table top 20 to receive the radial arms 28′ of the secondary frame members and offset slots 41, normal to the slot 40, receive the offsetting radial arms 28 of the primary section M. The manner in which each rod fits into the table is best shown at FIG. 9 where a rod 28 is fitted into the groove 40. Suitable latches 42 may be provided at each groove to lock the rods in place and secure the table top 20 to the frame. The latches 42 may be a snap type where the rod 28 is snapped in place, or if desired the latches may be of the type where the rod 28 is locked in place.

Figure 11:
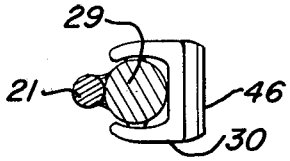
FIG. 11 is a fragmentary sectional detail as taken from the indicated line 11—11 at FIG. 9, but on an enlarged scale.
Figure 4:
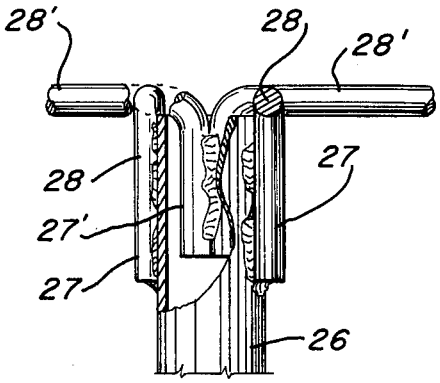
FIG. 4 is a fragmentary detail as taken from the indicated line 4—4 at FIG. 2, but on an enlarged scale with portions of the structure broken away to show parts otherwise hidden from view.
Figure 5:
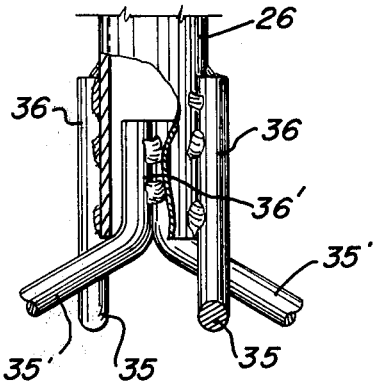
FIG. 5 is a fragmentary detail as taken from the indicated line 5—5 at FIG. 2, but on an enlarged scale with portions of the structure broken away to show parts otherwise hidden from view.

The display arms 21 carrying rods 29 can accommodate simple "U"-shaped clips 30 for holding a carpet sample D, as illustrated at FIGS. 9 and 11. The bosses 31 on each rod may be used to facilitate holding these clips 30 into place as illustrated. However, the clips may also be engaged at any point on the rods 29 by using a simple, horseshoe-shaped yoke 45 proportioned to grip the rod 29 whenever it is tilted on the rod. A hook 46 on this clip 30 holds the edging 47 of a display sample D as best illustrated at FIG. 9.

An important function of the tube 26 is to provide vertical rigidity to this frame when a small size of wire is used. This frame may be simplified where the rods 25 and 25' are increased in size to the point where they can support any ordinary weight placed upon the table without undue deflection. This modified embodiment is illustrated at FIGS. 12–15. In this arrangement, the primary frame M' is formed of two opposing rods 25*a*. The upper, downturned ends 27*a* of these rods are welded to a circular bearing 38. Thence, the rods 25*a* extend outwardly as radial arms 28*a*, downwardly as holding arms 21*a*, thence inwardly as a support struts 32*a* and to neck portions 33*a*. A circular bearing 39 is welded to these neck portions. Thence the rods 25*a* extend outwardly and downwardly as compression struts 34 to fold thereunder and return to the table axis as base struts 35*a* with upturned stubs 36*a* being welded to a bearing 40.

The secondary frame S' has the same general form as heretofore described, with the frame being formed by two opposing rods 25*a*. Commencing at the upper end of the frame, these rods include downturned ends 27*a'* which are welded to each other and fitted in the bearing 38. Thence the rods 25*a'* extend outwardly as radial arms 28*a'* to turn downwardly as holding arms 21*a'*, thence inwardly as support struts 32*a'* and to neck portions 33*a'*. The neck portions 33*a'* are welded together and are fitted in the bearing 39. Thence the rods 25*a'* extend outwardly as compression struts 34*a'* with upturned stubs 36*a'* being welded together and fitted in the bearing 40.

Figure 12:
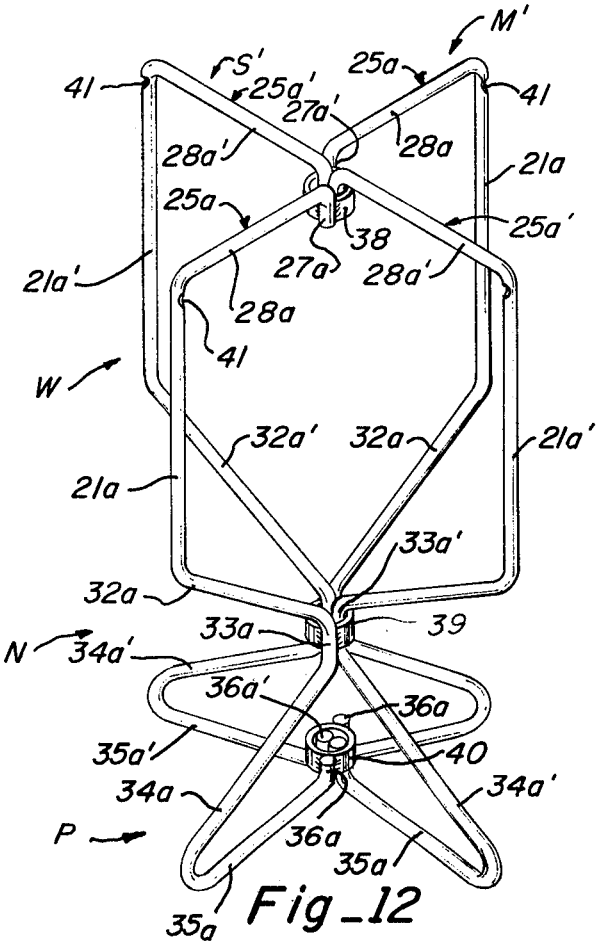
FIG. 12 is an isometric view similar to FIG. 2, but showing an alternate embodiment of the invention where an axial, tubular post is eliminated by the use of heavier frame wires.
Figure 13:
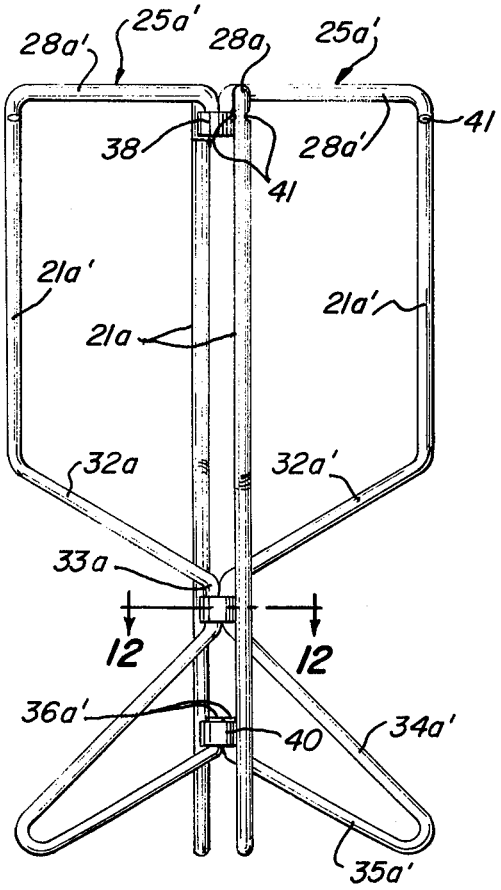
FIG. 13 is a side view of the unit shown at FIG. 12, as from the indicated arrow 13 at FIG. 12.
Figure 15:
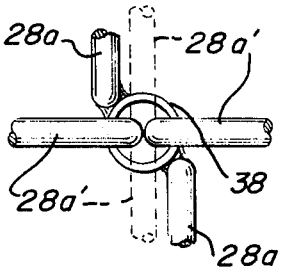
FIG. 15 is a fragmentary plan view of a portion of the showing at FIG. 15, but on an enlarged scale.
Figure 14:
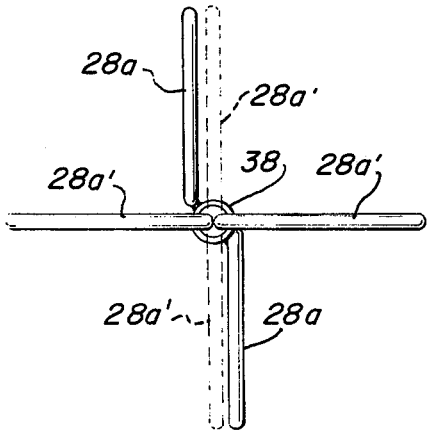
FIG. 14 is a plan view of the unit shown at FIG. 13, with dotted lines indicating the position of a frame member when folded against the other.

By using heavier rods, the holding arms 21*a* need not be reinforced or supplemented as by rods 29, but they may receive suitable clips 30*a* as indicated at FIG. 12. A narrowed section 41, at the top of each holding arm 21*a*, may be provided to receive the C-shaped clips as indicated. The arrangement and operation of this modified frame is the same as that heretofore described and the rods 25*a* of the primary section M' are offset from the plane through the table axis, at each side thereof, to permit the secondary section to rotate in the bearings 38, 39 and 40 from a position 90° from the rods 25 of the primary section and to a position alongside the rods forming the primary section as shown in dotted lines at FIGS. 14 and 15. It is to be noted that the neck portions 33*a'* of the secondary section S' fit in bearing 39 and are centered on the table axis instead of being offset a short distance as heretofore described.

It is to be noted that variations of the structure are possible and one simplification of the structure resides in eliminating the neck portion N and combining the pedestal P with the wing W. In this arrangement, not shown in the drawing, the holding arms 21, or 21*a*, which extend downwardly from the radial top arms 28, or 28*a*, will extend downwardly the entire height of the table to connect directly with the base struts 35, or 35*a*. This arrangement eliminates the strut 32*a*, the neck portion 33*a*, the bearing 39 and the compression strut 34*a*.

Yet other modifications of the invention are possible and while I have now described my invention in considerable detail, it is obvious that others skilled in the art can build and devise alternate and equivalent constructions which are nevertheless within the spirit and scope of my invention. Hence, I desire that my protection be limited, not by the constructions illustrated and described, but only by the proper scope of the appended claims.

What is claimed is:

1. A foldable display rack of the type having two peripheral frame sections of similar size and shape foldable along a vertical axis generally centrally of said two sections comprising:

a. the first of said two sections being rod-formed including straight opposed portions rigidly depending radially from a first position on said central axis, normal portions depending from the ends of said straight opposed portions forming parallel sides arranged to be vertical in use for hanging displays therefrom, inwardly directed portions extending from the opposed ends of said sides terminating at a second position on said central axis spaced from said first position, and outwardly directed opposed feet portions depending from said second position on said central axis including inturned portions depending from said feet portions terminating at a third position on said central axis;

b. bearing means mounted at each said first, second and third positions on said central axis;

c. the first section being rigidly secured to each said bearing means forming a generally planar peripheral frame section; and d. the second of said two sections being formed of two opposed portions, each formed of the shape of approximately one-half of said first sections, and each one-half portion being pivotally mounted in all said bearing means by axially extending portions, so that each of the opposed portions of said second section pivot from a normal position to said first section to a generally parallel, adjacent position to said first section but on opposed sides thereof.

2. A foldable display rack according to claim 1 being further characterized by a removable table top, and means cooperative with said table top and said straight opposed sections in open position for temporarily securing said table top thereon.

3. A foldable display rach according to claim 1, wherein said bearing means are joined together by a central member.

4. A foldable display rack according to claim 1, wherein said parallel sides include a separate rod member secured thereto and arranged to support hangers therefrom.

5. A foldable display rack according to claim 1, wherein each said outwardly directed feet portion includes a surface resting portion spaced adjacent the outmost portion of each, thereby forming four spaced apart feet for said rack.

* * * * *